US006896559B2

(12) United States Patent
Klein et al.

(10) Patent No.: US 6,896,559 B2
(45) Date of Patent: May 24, 2005

(54) PIN RETENTION APPARATUS, METHODS AND ARTICLES OF MANUFACTURE

(75) Inventors: David Allen Klein, Kernersville, NC (US); Earl Watson Hancock, Winston-Salem, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/389,485

(22) Filed: Mar. 14, 2003

(65) Prior Publication Data

US 2004/0180584 A1 Sep. 16, 2004

(51) Int. Cl.[7] ..... H01R 13/40
(52) U.S. Cl. ..... 439/733.1; 439/82; 439/885
(58) Field of Search ..... 439/874, 869, 439/82, 83, 844, 751, 567, 722, 736, 885, 886, 937, 733.1; 206/713, 347, 485; 29/845

(56) References Cited

U.S. PATENT DOCUMENTS 3,864,014 A * 2/1975 Lynch ..... 439/885
4,315,365 A * 2/1982 Wigby ..... 29/845
4,606,455 A * 8/1986 Grikis et al. ..... 206/347
6,042,429 A * 3/2000 Bianca et al. ..... 439/733.1
6,152,782 A * 11/2000 Volkert et al. ..... 439/733.1
6,328,576 B1 * 12/2001 Takahashi ..... 439/733.1

* cited by examiner

*Primary Examiner*—Tho D. Ta
*Assistant Examiner*—Felix O. Figueroa

(57) ABSTRACT

Header pins having improved positional stability and increased terminal retention are disclosed. The header pins have retention features spaced longitudinally apart and rotated around an axis. In one embodiment, two pairs of swaged retention features are created, spaced longitudinally apart, and the planes defining the retention features are displaced approximately ninety degrees (90°) apart. The pairs of retention features are disposed relatively near a central section of the header pin and at a distance from one another that is relatively less than the overall length of the header pin. A notch disposed in the body of the header pin is longitudinally spaced from the two pairs of retention features. Methods of making a header pin and improved methods of assembling a header block are also disclosed.

18 Claims, 4 Drawing Sheets

PIN RETENTION APPARATUS, METHODS AND ARTICLES OF MANUFACTURE

FIELD OF THE INVENTION

The present invention relates generally to an electrical connector assembly, and more particularly, the invention relates to header pins used in board-to-board and wire-to-board headers.

BACKGROUND OF THE INVENTION

Electrical connectors operate to provide an electrical pathway or junction, and in so doing provide a mechanical connection between wires, circuit boards, components or other current carrying devices. Headers are examples of connectors that provide an electrical junction between two circuit bards ("board-to-board") or between a cable assembly and a circuit board ("wire-to-board"), although, as is typically understood, a "board" may be an electrical component, circuit block or other device, and need not necessarily be a printed circuit board. In a typical header, a number of pins are inserted through a housing so that a portion of the pin remains extended from each side of the housing. The pins are made of an electrically conductive material and the housing is made of a dielectric material. The pins are usually retained within the housing by a press fit or similar mechanical connection, such as tabs or ears that engage the dielectric material of the housing primarily by friction.

Currently, the tabs that retain connector pins lack positional support in one plane. In other words, with conventional pin retention features, there is one direction in which there is little support resulting in possible true positional errors. Moreover, in currently available designs the retention forces required in particular applications are often difficult to maintain.

There exists, therefore, a need to provide improvements to the design of header pins, however, any improvements in the shortcomings noted above must be made in a manner in which the resulting design is capable of being manufactured in high volumes at high speeds to meet the demands of the electronics industry. For example, pressing and shaping pin stock into tabs using conventional presses has a limited number of directional and dimensional features that can be efficiently produced.

Certain prior art pins use a "star" feature and have four interference features arrayed around the body of a header pin. The pin necessarily has a thick cross-section to accommodate the four interference features. However, localizing the interference features also localizes the stresses in the assembly and thus increases the chances of localized cracking, particularly in the type of brass typically used for connector pins, which is relatively hard and non-malleable. Furthermore, the "star" feature design suffers in positional stability from not having its ears/tabs displaced from one another longitudinally.

Therefore, it would be desirable to provide connector pins that improve the retention and positional accuracy of the header, while reducing or eliminating stress concentrations. It would be further desirable to provide a design for such header pins that can be manufactured using conventional production equipment so that large quantities of such pins can be produced economically.

SUMMARY OF THE INVENTION

It has now been found that improved positional stability of header pins and increased terminal retention can be achieved while providing a design that is easy to manufacture by creating header pins that have retention features spaced longitudinally apart and rotated around the axis of the header pin. In accordance with an embodiment of the invention, a header pin is provided that has a first pair of pin retention features formed at a first location and defining a first plane, and a second pair of retention features formed at a second location spaced longitudinally along the body from the first location and defining a second plane displaced rotationally from the first plane. In one embodiment, the planes in which the sets of retention features are defined are displaced approximately ninety degrees (90°) from one another.

The body can have a circular cross-section and one of the ends can have a layer of solder. In some embodiments, the first and second locations are disposed relatively near a central section of the header pin are also preferably a distance from one another that is relatively less than the overall length of the header pin. Either one or both sets of retention features may be a swaged section forming laterally extending features, and these laterally extending features can be trapezoidal in cross-section and each one of them extends beyond the body of the header pin. In some embodiments, there is a notch disposed in the body of the header pin that is particularly useful if a plurality of the pins is placed in a bandolier.

The embodiments disclosed herein further include methods of making a header pin by providing a header pin having a body, swaging a first set of retention features at a first location along the body, and then swaging a second set of retention features at a second location along the body, such that the second location is displaced longitudinally from the first location. The swaging preferably forms a pair of laterally extending features to define a first plane and the step of swaging the second set of retention features comprises forming a pair of laterally extending features to define a second plane, and in certain embodiments, these are displaced approximately ninety degrees (90°) from one another. After each pin is manufactured, it can then be pressed into a bandolier, and preferably a notch has been formed in the pin for this purpose.

In another aspect of the invention improved methods of assembling a header are provided. In accordance with an embodiment of the invention, a plurality of pins are inserted into a header block, with the inserting step comprising inserting the header pin a sufficient depth so that a first retention feature and a second retention feature are displaced longitudinally and are frictionally engaged with the header block. Preferably, the engagement of the header pin and the header block comprises engaging the first retention feature along a first plane and the second retention feature along a second plane, wherein the first and the second planes are rotationally spaced around an axis.

DETAILED DESCRIPTION

Figure 1:
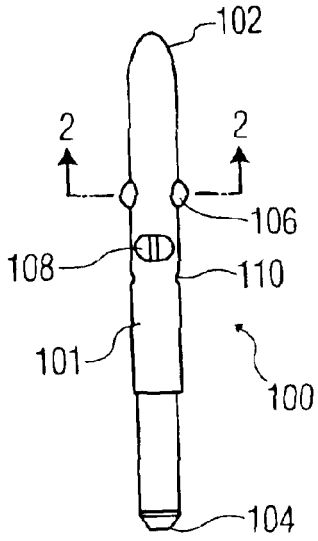
FIG. 1 is a plan view of a header pin in accordance with an embodiment of the present invention.

Referring now to the drawings in detail, wherein like reference numerals indicate like elements throughout the several views, there is illustrated in FIG. 1*a* header pin in accordance with an embodiment of the present invention. The header pin 100 as shown comprises a body 101 and two ends 102,104. In this embodiment, one of the two ends 102, 104 may be provided having a layer of solder, but is not required. The header pin 100 also includes one or more and preferably a pair of pin retention features 106 formed at a first location along the body 101, and one or more and preferably a pair of retention features 108 formed at a second location spaced longitudinally along the body 101 from the first pair of retention features 106. The first pair of retention features 106 are preferably disposed in a plane displaced rotationally from the plane of the second pair of retention features 108. In certain embodiments, it may be desirable to form a notch 110 in the body 101, such as shown in FIG. 1. Generally, the first and second sets of retention features or "fins" 106,108 are located proximate the central area of the body 101. In the embodiment illustrated in FIG. 1, since retention features 106, 108 are not located directly at the center of the body 101, upon assembly into a header block (not shown), one end will extend a longer length than the other end. For example, assuming an overall length of the header pin 100 being 23.5 millimeters, the first set of retention features 106 may be displaced about 7.5–8.0 millimeters from the first end 102, and the second set of retention features may be spaced about 10.0–10.5 millimeters from the first end 102. It should be understood, therefore, that the first and second sets of retention features 106,108 are relatively close together in the present embodiment. In the example illustrated in FIG. 1, the first and second sets of retention features 106,108 are spaced about 2.5–3.0 millimeters apart. These spacings and arrangements are representative and the present embodiment is not limited to these dimensions or relative spacing.

Figure 2:
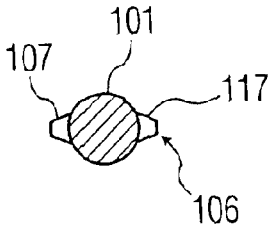
FIG. 2 is a cross-sectional view of the header pin of FIG. 1 taken along line 2—2 shown in FIG. 1.

Referring now to FIG. 2, there is shown a cross-sectional view of pin 100 taken along line 2—2 in FIG. 1. As shown, the body 101 is substantially circular in cross-section and the first set of retention features 106 comprise a pair of laterally extending features 107,117 spaced approximately one-hundred eighty degrees apart, and with each being substantially trapezoidal in cross-section and extending laterally from the body 101. It should be noted however, that the laterally extending features 107, 117 may take on a variety of cross sectional geometrical shapes, such as rectangular. Although not shown in FIG. 2, the second set of retention features 108 are also approximately one-hundred eighty degrees apart from one another in this embodiment and of the same configuration as features 107, 117. A comparison of FIG. 1 and FIG. 2 illustrates that in the present embodiment of the invention, the plane of the first set of retention features 106 and the plane of the second set of retention features 108 are displaced approximately ninety degrees (90°) apart from one another. It should be understood, however, that other configurations and/or rotational displacements of the various retention features can be utilized where desired and still provide the advantages of the header pins disclosed herein.

Figure 3:
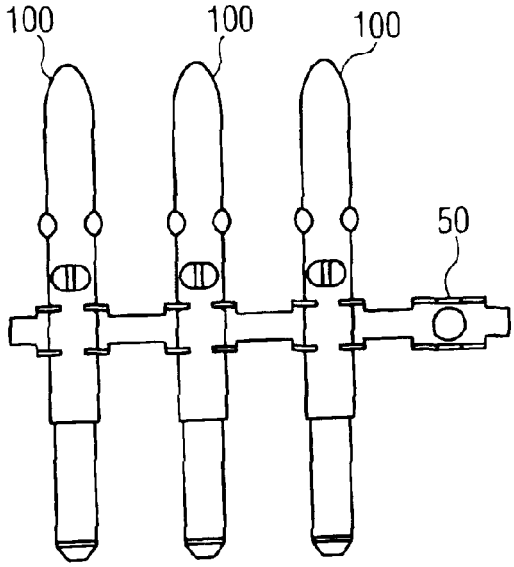
FIG. 3 is a plan view of a plurality of header pins similar to that shown in FIG. 1, illustrated with a bandolier.
Figure 4:
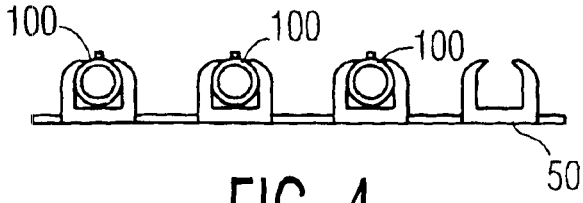
FIG. 4 is an elevational view of the plurality of header pins and bandolier shown in FIG. 3.

Referring now to FIGS. 3–4, a plurality of header pins 100 similar to that illustrated in FIGS. 1–2 are shown attached to a bandolier 50 The header pins 100 can be pressed or snapped into the bandolier 50, and in this manner, efficiently inserted into header blocks or similar structures using automated equipment. The notch 110 illustrated in FIG. 1 may be provided to retain the header pins 101 in the bandolier 50, as shown in FIGS. 3–4.

Figure 5:
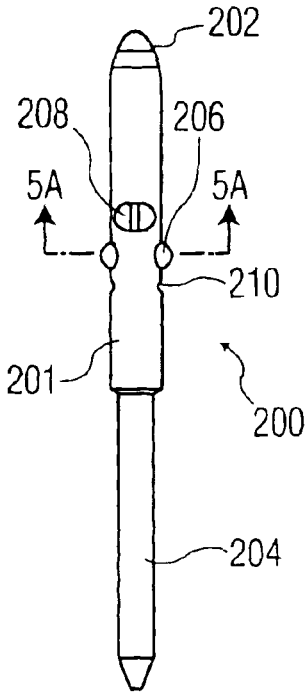
FIG. 5 is a plan view of a header pin in accordance with another embodiment of the present invention.
Figure 5A:
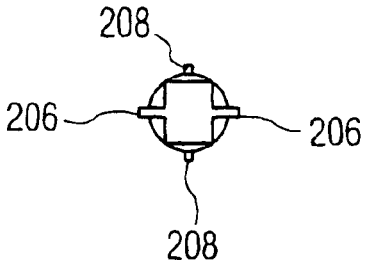
FIG. 5A is a cross-sectional view of the header pin of FIG. 5 taken along line 5A—5A shown in FIG. 5.
Figure 6:
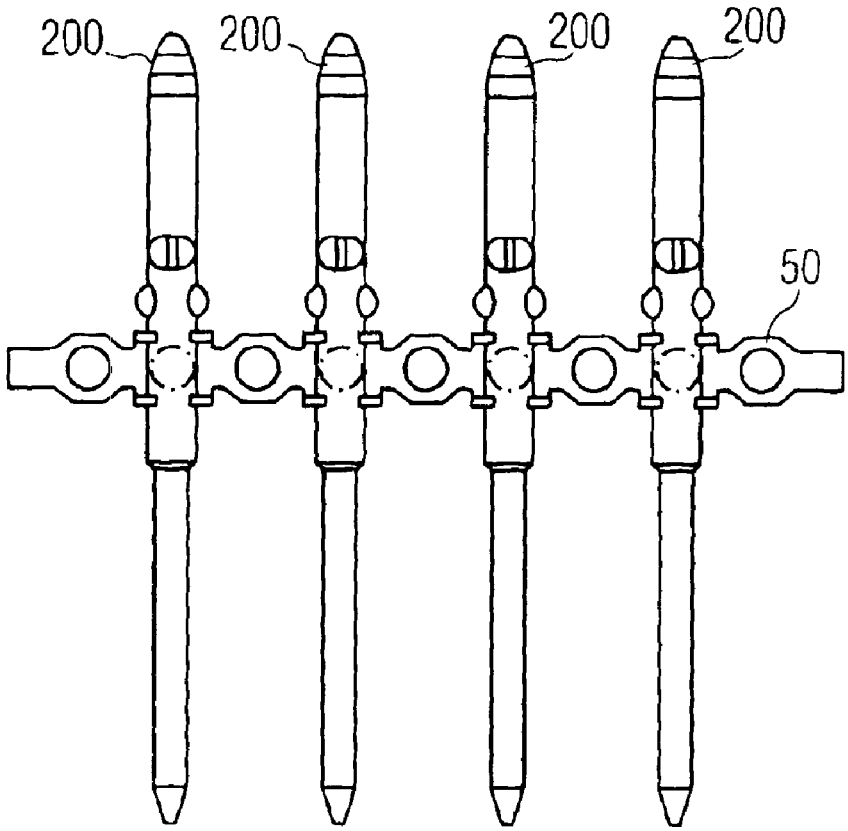
FIG. 6 is a plan view of a plurality of header pins similar to that shown in FIG. 5, illustrated with a bandolier.
Figure 7:
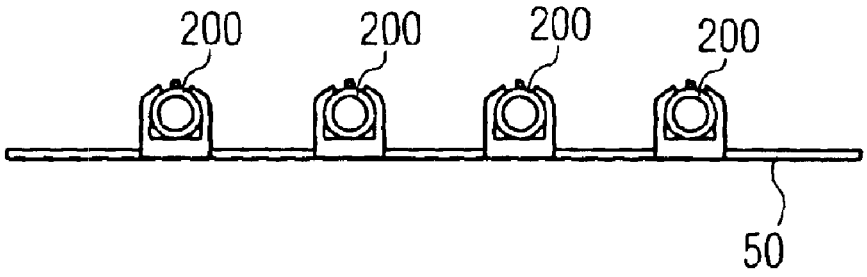
FIG. 7 is an elevational view of the plurality of header pins and bandolier shown in FIG. 6.

Another exemplary embodiment of a header pin is illustrated in FIGS. 5–7. In the embodiment illustrated in FIG. 5, the header pin 200 is somewhat longer and of a smaller cross section than the header pin 100 illustrated in FIG. 1. As with the header pin 100, header pin 200 includes retention features 206, 208 provided in two locations spaced longitudinally apart and also spaced rotationally in different planes, as shown in the cross-sectional view of FIG. 5A.

In the present embodiment, the retention features 206, 208 are spaced from one another about 1.2 mm in a longitudinal direction and rotated to be at substantially right angles (i.e., 90 degrees apart). The cross-section of each of the fins 206,208 is relatively small in this embodiment (i.e., 0.23 mm+/−0.05 mm) and when combined with other dimensional features of the header pin 200, provides suitable insertion and extraction values without unduly distorting or deforming the plastic material of the header block. In the present embodiment, for example, with four points of about 0.23 mm of cross-sectional interference, only about 0.17 mm per side or a total of about 0.342+/−0.05 mm of interference on the diameter is required. As illustrated in FIGS. 6 and 7, the embodiment shown in FIG. 5 may also be manufactured into a bandolier 50 and include a notch 210 to assist in retaining the header pin 200 in the bandolier 50, similar to the embodiment of FIG. 1.

Those of skill in the art will appreciate that the embodiments disclosed herein provide a header pin having improved positional support on each of the four sides, i.e., in orthogonal directions. In addition, a plurality of retention features provides improved retention force, yet permits the pin to be easily inserted and removed, without causing excessive stress, either in the metal of the pin or the plastic of the connector. Finally, the longitudinal offset of the retention features in the illustrated embodiments allows the tooling to better form the necessary shape(s) without cracking material or deforming adjacent features.

Another aspect of the embodiments disclosed herein is to provide methods of manufacturing header pins. One exemplary method comprises the steps of forming a first set of retention features at a first location along the body of the header pin and then forming a second set of retention features at a second location along the body, the second location being displaced longitudinally from the first location. The steps of forming of the retention features may be accomplished in a variety of different ways. One example is swaging, although as should be understood, other suitable operations can be used, such as stamping, coining, forging and the like. Further, where desired, casting may also be utilized to create the features disclosed above or thermoforming using molds or dies. Regardless of the technique used, the step of swaging or forming the retention features involves forming two sets of retention features in two different planes, and as discussed above, in certain embodiments, it will be preferred that the first plane and the second plane are displaced from one another, such as approximately ninety degrees (90°).

Figure 8A:
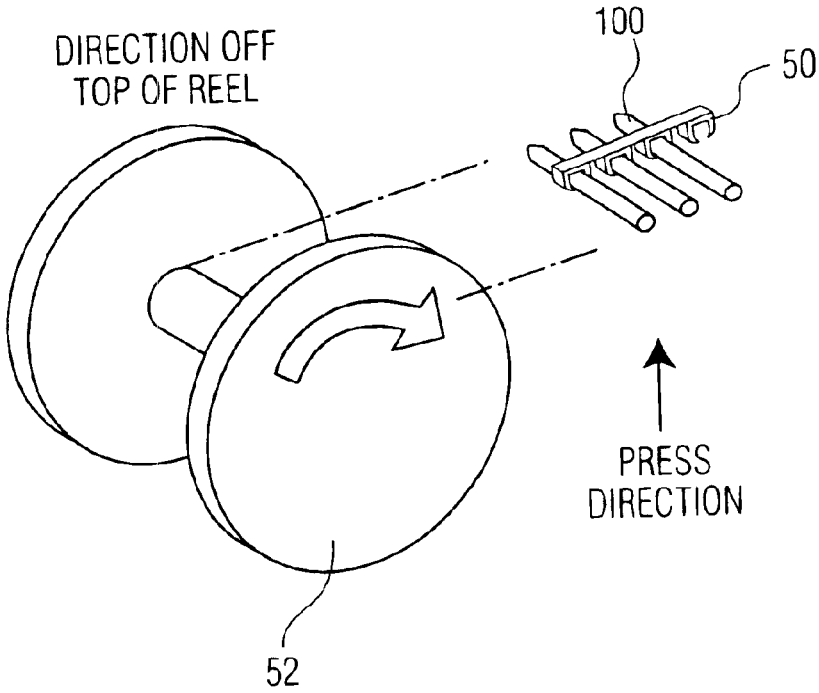
FIGS. 8A–8B illustrate an exemplary orientation of header pins held on a bandolier and rolled on to a reel during manufacture.
Figure 8B:
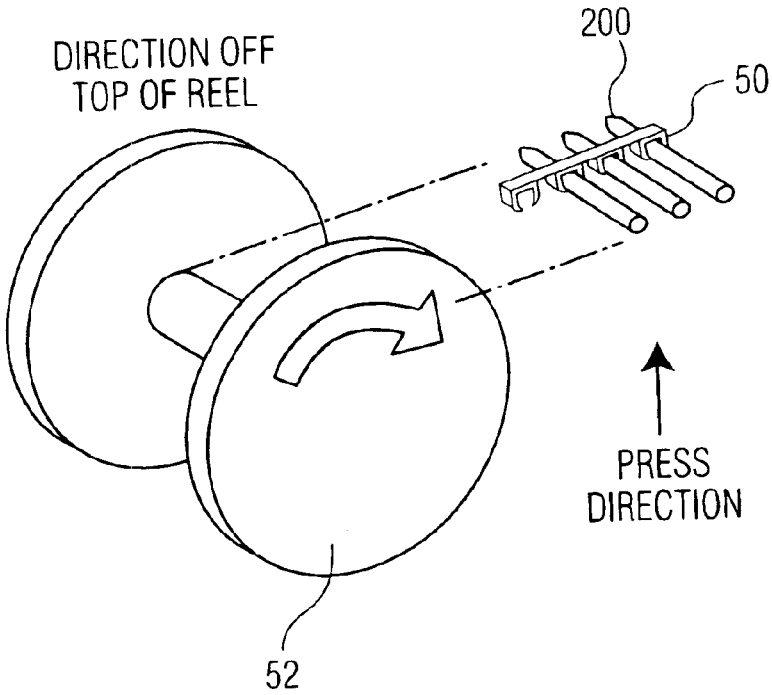

An additional aspect of the manufacturing process is illustrated in FIGS. 8A–8B. As discussed above, after the header pins are formed, they can be pressed into a bandolier 50. It may be desirable in some instances for the header pins to include a notch formed in the body, so as to provide a more secure engagement with the bandolier 50. For this purpose, the step of pressing the header pin 100,200 into the bandolier 50 will include the step of the bandolier 50 engaging the notch 110,210. The bandolier may then be wrapped on a reel 52, such as illustrated in FIGS. 8A–8B.

Finally, the embodiments disclosed herein also include methods of assembling a header by inserting a plurality of pins into a header block. For example, with respect to the header pins in the illustrated embodiments, the step of inserting the header pins into the header block will include pushing the header pin to a sufficient depth so that the first retention feature and the second retention are frictionally engaged with the header block. As discussed above, the frictional engagement of the header block with the header pin results with a first retention feature along a first plane and a second retention feature along a second plane all being engaged with the header block, and with the first and the second planes being rotationally spaced around an axis.

As noted above, the retention features improve the positional stability of the pin, increase the terminal retention and result with the pins being easier to manufacture. The placement of retention features spaced longitudinally apart and rotated around the axis of the header pin provides these improvements yet results in a design that is readily manufactured.

Although this invention has been described with reference to particular embodiments, it will be appreciated that many variations adaptations, modifications, and alterations may be resorted to without departing from the spirit and scope of this invention as set forth in the appended claims.

What is claimed is:

1. A header pin comprising a body and one or more first pin retention features provided at a first location and defining a first plane, and one or more second pin retention features provided at a second location spaced longitudinally along the body from the first location and defining a second plane displaced rotationally from the first plane, wherein the header pin further comprises a notch disposed in the body of the header pin, securing the header pin to a bandolier, and wherein a portion of the bandolier is received by the notch.

2. The header pin of claim 1, wherein the first plane and the second plane are displaced approximately ninety degrees (90°) from one another.

3. The header pin of claim 1, wherein the body has a circular cross-section.

4. The header pin of claim 1, wherein the first and second locations are disposed relatively near a central section of the header pin.

5. The header pin of claim 1, wherein the header pin has an overall length and the first and second locations are disposed a distance from one another and the distance is relatively less than the overall length of the header pin.

6. The header pin of claim 1, wherein the one or more first retention features comprises a pair of laterally extending features.

7. The header pin of claim 6, wherein the laterally extending features are substantially trapezoidal in cross-section.

8. The header pin of claim 7, wherein each one of the laterally extending features extends beyond the body of the header pin.

9. The header pin of claim 6, wherein the one or more second retention features comprises a pair of laterally extending features.

10. The header pin of claim 9, wherein the laterally extending features are substantially trapezoidal in cross-section.

11. The header pin of claim 10, wherein each one of the laterally extending features extends beyond the body of the header pin.

12. The header pin of claim 1, wherein the notch is operationally independent from each of the one or more first and second pin retention features.

13. An apparatus comprising:

a bandolier for holding at least one header pin; and at least one header pin comprising a body and one or more first pin retention features provided at a first location and defining a first plane, and one or more second pin retention features provided at a second location spaced longitudinally along the body from the first location and defining a second plane displaced rotationally from the first plane, wherein one of the bandolier or the body of the header pin further comprises a securing member therein for securing the at least one header pin to the bandolier, and wherein the securing member comprises a notch, with a portion of the bandolier or the body of the header pin received in the notch.

14. The apparatus of claim 13, wherein the notch is operationally independent from the one or more first and one or more second pin retention features.

15. A method of assembling a header comprising the steps of:

inserting a plurality of pins into a header block, wherein said inserting step comprises inserting the header pin a sufficient depth so that a first retention feature and a second retention feature displaced longitudinally from the first retention feature are frictionally engaged with the header block;

wherein each of the plurality of pins further includes at least one notch longitudinally displaced from each of the first and second retention features, said notch for retaining the plurality of pins prior to insertion in the header block; and wherein a bandolier has a portion received into the at least one notch of each of the plurality of pins for retaining the plurality of pins prior to insertion in the header block.

16. The method of claim 15, wherein the step of frictionally engaging the header block comprises engaging the first retention feature along a first plane and the second retention feature along a second plane, wherein the first and the second plane are rotationally spaced around an axis.

17. The method of claim 15, wherein the securing member comprises a pair of notches in the body of the header pin, with each of the pair of notches receiving portions of the bandolier.

18. The method of claim 15, wherein the at least one notch is operationally independent from each of the first and second retention features.

* * * * *